United States Patent [19]

Pallo et al.

[11] Patent Number: 4,581,882

[45] Date of Patent: Apr. 15, 1986

[54] REFRACTORY FIBER ROPE PACKING

[75] Inventors: John M. Pallo, Englewood, Colo.; Bernard L. Kotyuk, Manville, N.J.

[73] Assignee: Manville Service Corporation, Denver, Colo.

[21] Appl. No.: 662,859

[22] Filed: Oct. 19, 1984

[51] Int. Cl.[4] ..... B65D 53/00; D02G 3/08; D02G 3/18; D02G 3/44

[52] U.S. Cl. ..... 57/211; 57/229; 57/233; 57/235; 57/238; 57/3; 277/227; 277/DIG. 6; 428/337

[58] Field of Search ..... 277/227, DIG. 6; 57/3, 57/211, 229, 233, 235, 238; 428/377

[56] References Cited

U.S. PATENT DOCUMENTS

| | | | |
|---|---|---|---|
| 1,585,612 | 5/1926 | Heany | 57/233 |
| 1,585,619 | 5/1926 | Heany | 57/233 |
| 1,927,477 | 9/1933 | Walton | 57/211 |
| 2,736,163 | 2/1956 | Morrison | 57/229 |
| 2,832,190 | 4/1958 | Bacon | 57/235 |
| 4,430,384 | 2/1984 | George | 428/377 |
| 4,430,851 | 2/1984 | Sundet | 57/211 |
| 4,502,364 | 3/1985 | Zucker et al. | 57/229 |
| 4,529,653 | 7/1985 | Hargreaves et al. | 277/DIG. 6 |
| 4,529,662 | 7/1985 | Lancaster et al. | 277/227 |
| 4,529,663 | 7/1985 | Lancaster et al. | 277/227 |

*Primary Examiner*—James C. Cannon

*Attorney, Agent, or Firm*—John D. Lister; Cornelius P. Quinn; Gregory A. Evearitt

[57] ABSTRACT

An asbestos-free rope packing comprising at least 3 strands of a twisted, ceramic fiber-containing paper wherein:

(a) each of said strands contains at least one carrier insert;

(b) said twisted ceramic fiber-containing paper contains about 3–9 wt. % of a suitable bonding agent;

(c) said paper has a thickness of about 0.0015 to 0.045 inches; and (d) said paper has a width of about 0.50 to 4.0 inches.

Also, a process for forming the rope packing from twisted strands of a ceramic fiber-containing paper is provided.

18 Claims, 1 Drawing Figure

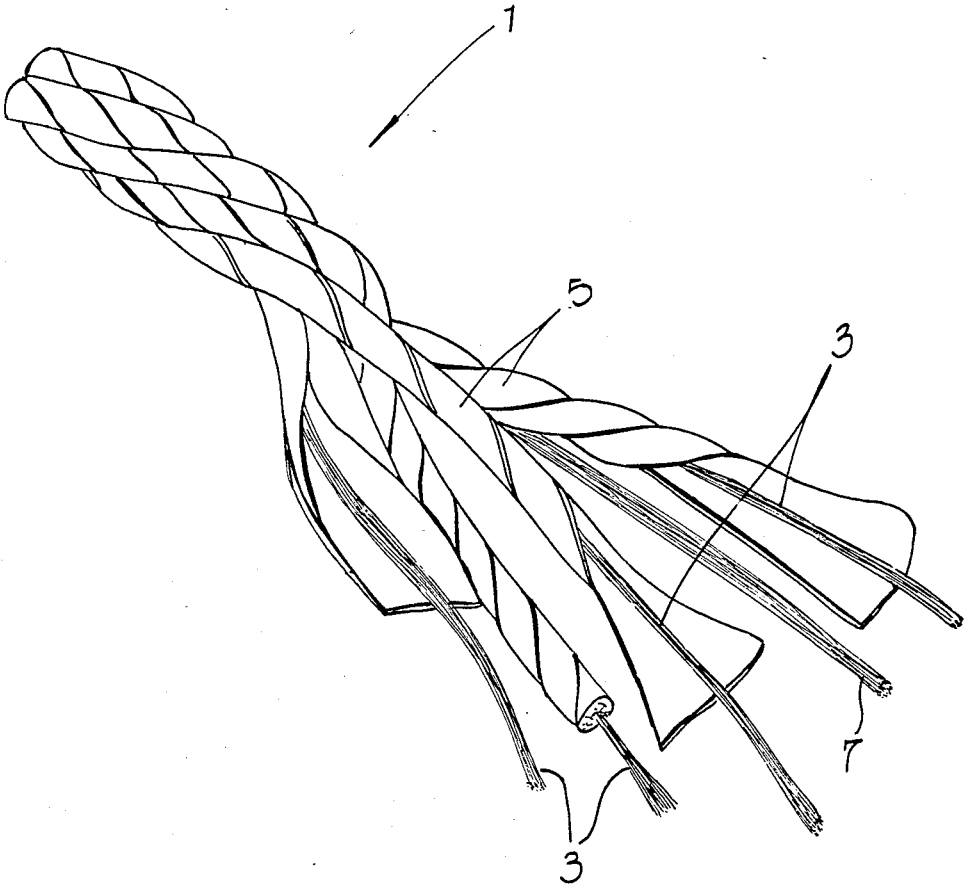
1
5
3
7
3

REFRACTORY FIBER ROPE PACKING

The present invention relates to an asbestos-free ceramic fiber rope packing.

Rope packings, which are generally either twisted rope or braided rope packings, are ideal general-purpose packings. They can be used for emergency packing and gasketing where other materials are not available. The packings can also be used as packings where the shape or condition of the equipment will not allow the use of less pliable, less adaptable materials. These packings are commonly used in grooves for door sealings, between boiler sections and expansion joints. They can also be used for wrapping steam and exhaust lines where space limitations preclude formed insulation as well as for many other uses.

In the past, such packing have been made by either twisting, braiding or plaiting carded slivers, yarn and/or rovings of various fibers (typically asbestos fiber) or strips of light density asbestos paper. Asbestos heretofore has been desirable because of its properties of high strength, alkali-resistance, high heat-resistance, fire-resistance, and easy processability.

While these asbestos containing rope packings have proved to be effective over the years, alternatives to asbestos have been searched for by the industry. The uncertain supply of uniform quality asbestos fiber, the relatively high cost of manufacturing such fiber into rope form and the need to use a special grade of asbestos fiber for packings utilized in acid service have created the need to find a replacement for asbestos.

Alternatives to the use of asbestos fibers in rope packings have been developed by various manufacturers. However, the tedious, time consuming process of carding the various fibers, as in the case of asbestos, into a rope packing is still encountered. Also, large amounts of binder (as high as 25%) are commonly used in the existing rope packing manufacturing processes which means, of course, that the amount of fiber in the rope packing itself is cut down which can lower the overall temperature and chemical resistance of the rope packing and thus limit its commercial use. Such commercially available rope packings have a further disadvantage in that they can be difficult to caulk and fit into tight, narrow spaces such as grooves for door sealings, between boiler sections and expansion joints.

In the course of trying to find effective replacements for current commercially available rope packing products, the idea was developed to manufacture a rope packing product from twisted strands of a ceramic fiber-containing paper. The use of a paper containing a ceramic fiber in the rope packing process avoids the previously mentioned problem of carding the fiber itself into a rope packing which can be very tedious and time consuming.

Additionally, the use of a ceramic fiber-containing paper drastically lowers the amount of binder which mus be used compared to that mentioned earlier in the specification in other commercial products. Consequently, this allows for a greater concentration of ceramic fiber in the rope packing itself which offers the advantages of higher temperature resistance and durability. Finally, the rope packings of this invention have been found to have excellent caulkability characteristics such that they can be easily fit into narrow, tight spaces such as grooves for door seaings, between boiler sections and expansion joints.

Accordingly, it is an object of the present invention to provide an effective rope packing product which has all of the above named advantages.

Other aspects, objects, and the several advantages of the present invention will be apparent to one skilled in the art from the specification, the appended claims, and the attached drawing which is a schematic representation of the present invention.

In accordance with the present invention, we have discovered a highly effective asbestos-free rope packing. The rope packing of the present invention comprises at least three strands of a twistable ceramic fiber-containing paper.

As used herein, the term ceramic fiber is intended to include any non-asbestos fibers which are produced from non-metallic inorganic materials and which are capable of withstanding temperatures of at least 1200° F., preferably at least 1600° F., and most preferably at least 2400° F. Generic examples of such non-asbestos ceramic fibers include refractory fibers, semi-refractory fibers, mineral wool, glass fibers, and combinations thereof depending upon temperature requirements.

The ceramic fibers utilized in the present invention should generally be 2–7 microns in diameter, ½ to 10 inches in length (2–3 inch average), and have a varying shot content (35–45% usually).

The ceramic fiber-containing paper may be made by any method commercially available or known to those skilled in the art.

For the purposes of the present invention, the final ceramic fiber-containing paper should have a thickness between about 0.015 and 0.045 inches, a width of between about 0.50 and 4.0 inches, and a binder content of between about 3 and 9 wt.% based upon the weight of the final ceramic fiber-containing paper product.

Preferably, the ceramic fiber paper should have a thickness between about 0.018 and 0.035 inches, a width between about 0.750 and 2.125 inches, and a binder content between about 4 and 7 wt.%.

Generally, the ceramic fiber paper of the present invention will have a tensile strength of about 4 to 8 lb/in (Machine Directional) and 3 to 6 lb/in (Cross Directional), preferably about 5 to 7 lb/in (MD) and 3 to 5 lb/in (CD).

Also, the ceramic fiber paper will generally have a density of about 15 to 19 pcf, preferably about 16 to 18 pcf.

Any suitable bonding agent such as a phenolic resin, latex, acrylic or colloidal silica based bonding agent may be used. Preferably, the bonding agent will be an acrylic based one. In any event, the bonding agent must be one compatible to the manufacturing process in order to impart twistable properties and tearing resistance during the rope manufacturing process.

Each strand of twisted ceramic fiber paper will have at least one carrier insert. The term "carrier insert" is intended to include any of the materials which have the requisite length, strength, flexibility, and surface characteristics which will impart the necessary strength to resist tearing required during the twisting operation. Typically, the carrier insert is one of roving yarn or thread composed of glass, cotton, ceramic or synthetic fibers. An examplary carrier insert is rayon yarn. Generally, the rope packing of the present invention can be made from any conventional process. Typically, though, the rope packing is made by the following generalize process:

The ceramic fiber-containing paper plus carrier insert is initially fed into a Haskell-Dawes type twister having variable twist capabilities to initially form the material into a twisted cord, ⅛" and ¼" diameter. Multiple ends of these cords are fed into a Haskell-Dawes type rope twisting machine to form various rope diameters. The rope construction consists of multiple cord strands that are fed in parallel form through a rubber adhesive while the remaining outer strands are fed through a circumferential spacer shield to be twisted about the rubber treated core strands. The rubber adhesive prevents the outer circumferential ends from untwisting during packaging and installation of the product. This core construction provides a dense, uniform ceramic fiber rope packing.

The use of a ceramic fiber-containing paper in the manufacture of the rope packing of the present invention offers the several advantages outlined earlier. The ceramic fibers utilizable in the present invention are currently more abundant than asbestos fibers and are much cheaper as well. Incorporating the ceramic fibers into the form of a paper also allows for easier manufacture of the rope packing itself because the process of twisting the paper into a rope packing is much cheaper and faster than carding the fiber itself into a rope packing. Low amounts of the binder allow for a greater concentration of ceramic fiber in the rope packing itself which gives a greater temperature resistance and durability to the rope packing. The wetability and blendability of the fibers into a paper of uniform thickness and density provide a rope packing having minimal diameter and density variations thereby eliminating possible failure areas in use. Finally, the rope packing of the present invention may be easily caulked or fitted into narrow, tight spaced such as grooves for oven doors, etc.

In one preferred embodiment of the present invention, the rope packing is produced by twisting a paper made from a ceramic fiber consisting essentially of about 46–52 wt.% $SiO_2$, 32–38 wt.% $Al_2O_3$ and 13–18 wt.% $ZrO_2$ wherein the silica to zirconia ratio is in the range of from about 2.6 to 3.8. Preferably, the ceramic fiber consists essentially of about 46.4–50.1 wt.% $SiO_2$, 32.0–37.3 wt.% $Al_2O_3$, and 15.0–18.0 wt.% $ZrO_2$ wherein the silica to zirconia ratio is in the range of from about 2.60 to 3.32.

This rope product offers the properties of high temperature resistance (to 2650° F.), alkaline resistance, low shrinkability, and low cost, all of these advantageous properties being provided without the use of asbestos.

In a second preferred embodiment of the present invention, an asbestos-free rope packing product which is both alkali-acid resistant is provided.

The rope packing is made from a ceramic fiber-containing paper wherein the ceramic fiber consists essentially of the following ingredients at the indicated weight percent ranges: about 45–76% $SiO_2$, 12–32% $Al_2O_3$, and 5–30% $ZrO_2$ such that the silica to alumina ratio in the ceramic fiber is in the range of about 1.8 to 4.0. Preferably, the ceramic fiber will contain, by weight percent, about 49.7–73.3% $SiO_2$, 18.7–31.5% $Al_2O_3$, and 5.1–27.4% $ZrO_2$ such that the silica to alumina ratio is in the range of from about 1.8 to 3.5.

The ceramic fiber may also contain up to about 10% by weight of alkaline earth oxides.

The asbestos-free rope packing of the second preferred embodiment of the present invention offers the properties of both alkali-acid resistance, moderate temperature resistance (to 2200° F.), low shrinkability, and low cost.

In a third preferred embodiment of the present invention, another rope packing wherein the ceramic fiber consists essentially of about 47–57 wt.% silica (preferably 50–54 wt.%, most preferably 52 wt.%) and about 43–53 wt.% alumina (preferably 46–50 wt.%, most preferably 48 wt.%) is provided. The rope packing of the third embodiment of the present invention offers the advantages of being economical, of being at least mildly alkali/acid resistant and of being temperature resistant up to about 2400° F.

Another preferred rope packing is made from a ceramic fiber-containing paper wherein the ceramic fiber consists essentially of about 35–45 wt.% alumina (preferably 38–42 wt.%, most preferably 40 wt.%), about 45–55 wt.% silica (preferably about 48–52 wt.%, most preferably about 50 wt.%), and about 0.5–10 wt.% each of calcium and magnesium (preferably 3–7 wt.% and most preferably 5 wt.% each). This rope packing is economical, temperature resistant up to about 1600° F. and may be used in applications where an especially light-weight rope packing is desired.

A rope packing made from a ceramic fiber-containing paper wherein the fiber contains about 0.5–5 wt.% chromia (preferably 2–4 wt.% and most preferably 2.5 wt.%), about 38–55 wt.% alumina (preferably 40–46 wt.%, most preferably 43 wt.%) and about 49–59 wt.% silica (preferably 52–56 wt.%, most preferably 54.5 wt.%) is also provided. This rope packing is ecnomical as well as suitable for temperatures up to about 2600° F.

BRIEF DESCRIPTION OF THE DRAWING

The FIGURE shows the packing of the present invention.

DETAILED DESCRIPTION OF THE DRAWING

With reference to the attached drawing, numeral 1 refers to the overall twisted, ceramic fiber rope packing as manufactured. Specifically, numeral 3 refers to a carrier insert each of which is rather flexible in nature. Numeral 5 refers to a twisted strand of ceramic fiber-containing paper, each strand of said paper containing a carrier insert 3. Preferably, the rope packing 1 will contain at least one carrier insert 7 which is more rigid in nature than each carrier insert 3.

Reasonable variations and modificaions are possible within the scope of the foregoing disclosure without departing from the spirit thereof.

We claim:

1. A non-asbestos rope packing comprising at least 3 strands of a twisted, ceramic fiber-containing paper wherein:

(a) each of said strands contains at least one carrier insert;

(b) said twisted ceramic fiber-containing paper contains about 3–9 wt.% of a suitable bonding agent;

(c) said paper has a thickness of about 0.015 to 0.045 inches; and (d) said paper has a width of about 0.50 to 4.0 inches.

2. A rope packing according to claim 1 wherein said carrier insert in 1(a) is either a texturized fiber glass roving or yarn.

3. A rope packing according to claim 1 wherein said ceramic fiber is resistant to temperatures of at least about 1200° F.

4. A rope packing according to claim 1 wherein said paper in 1(b) contains about 4–7 wt.% of said bonding agent.

5. A rope packing according to claim 1 wherein said bonding agent in 1(b) is an acrylic based bonding agent.

6. A rope packing according to claim 1 wherein the thickness of said paper is about 0.018 to 0.035 inches.

7. A rope packing according to claim 1 wherein the width of said paper is about 0.750 to 2.125 inches.

8. A rope packing according to claim 1 wherein said ceramic fiber consists essentially of about 46–52 wt.% $SiO_2$, 32–38 wt.% $Al_2O_3$, and 13–18 wt.% $ZrO_2$ such that the ratio of $SiO_2$ to ZrO'in said ceramic fiber is in the range of from about 2.6 to 3.8.

9. A rope packing according to claim 1 wherein said ceramic fiber consists essentially of about 45–76 wt.% $SiO_2$, 12–32 wt.% $Al_2O_3$, and 5–30 wt.% $ZrO_2$ such that the ratio of $SiO_2$ to $Al_2O_3$ in the ceramic fiber is in the range of 1.8 to 4.0.

10. A rope packing according to claim 1 wherein said ceramic fiber consists essentially of about 47–57 wt.% silica and about 43–53 wt.% alumina.

11. A rope packing according to claim 1 wherein said ceramic fiber consists essentially of about 35–45 wt.% alumina, 45–55 wt.% silica, 0.5–10 wt.% calcium and 0.5–10 wt.% magnesium.

12. A rope packing according to claim 1 wherein said ceramic fiber consists essentially of about 0.5–5 wt.% chromia, 38–55wt.% alumina, and 49–59 wt.% silica.

13. A process for manufacturing an asbestos free rope packing comprising the steps of:

(a) forming a sheet of ceramic fiber-containing paper and at least one carrier insert into a twisted strand; and (b) thereafter, taking at least three of said twisted strands and further twisting said strands together into a rope packing of desired dimensions.

14. A process according to claim 13 wherein said ceramic fiber-containing paper has a thickness of about 0.015 to 0.045 inches and a width of about 0.50 to 4.0 inches.

15. A process according to claim 14 wherein said ceramic fiber-containing paper has a thickness of about 0.018 to 0.035 inches and a width of from about 0.750 to 2.125 inches.

16. A process according to claim 13 wherein said ceramic fiber-containing paper contains about 3–9 wt.% of a suitable bonding agent.

17. A process according to claim 16 wherein said ceramic fiber-containing paper has about 4–7 wt.% of a suitable bonding agent.

18. A process according to claim 13 wherein said carrier insert is either a texturized fiber glass roving or yarn.

* * * * *